US011389021B1

(12) United States Patent
McDaniel et al.

(10) Patent No.: US 11,389,021 B1
(45) Date of Patent: Jul. 19, 2022

(54) TASTING FLIGHT KITS

(71) Applicants: Kegan McDaniel, Milwaukee, WI (US); Roberto Meza, Niles, IL (US)

(72) Inventors: Kegan McDaniel, Milwaukee, WI (US); Roberto Meza, Niles, IL (US)

( * ) Notice: Subject to any disclaimer, the term of this patent is extended or adjusted under 35 U.S.C. 154(b) by 0 days.

(21) Appl. No.: 17/210,102

(22) Filed: Mar. 23, 2021

(51) Int. Cl.

| | |
|---|---|
| ***A47G 23/06*** | (2006.01) |
| ***B65D 71/52*** | (2006.01) |
| ***B65D 25/20*** | (2006.01) |
| ***A47G 19/22*** | (2006.01) |
| ***B65D 1/26*** | (2006.01) |

(52) U.S. Cl.
CPC ..... *A47G 23/0641* (2013.01); *A47G 19/2227* (2013.01); *B65D 1/265* (2013.01); *B65D 25/205* (2013.01); *B65D 71/0003* (2013.01); *B65D 2203/02* (2013.01)

(58) Field of Classification Search
CPC ..... A47G 23/0641; A47G 19/2227; B65D 1/265; B65D 25/205; B65D 71/0003; B65D 2203/02
USPC ..... 206/139, 223
See application file for complete search history.

(56) References Cited

U.S. PATENT DOCUMENTS 2,976,629 A * 3/1961 Lubis ..... G09F 3/16 40/310
5,358,770 A * 10/1994 Evans ..... B44C 5/00 40/310
5,899,515 A * 5/1999 Burns ..... B65D 71/50 294/87.28
6,741,150 B2 * 5/2004 Holmes ..... A47G 19/2227 63/3
9,852,662 B2 * 12/2017 Williams ..... G09F 3/16
10,531,752 B2 * 1/2020 Cherry ..... A47G 19/2227
10,657,545 B2 * 5/2020 McDougal ..... G06Q 30/0201
2001/0042729 A1 * 11/2001 Gale ..... B65D 51/24 215/393
2006/0207132 A1 * 9/2006 Vaughan ..... G09F 23/00 40/310
2008/0191112 A1 * 8/2008 Parker ..... A47G 23/0208 248/312
2008/0264822 A1 * 10/2008 Faiola ..... A47G 23/0641 206/557
2019/0024970 A1 * 1/2019 Sapia ..... A47G 23/0208

* cited by examiner

*Primary Examiner* — Steven A. Reynolds
(74) *Attorney, Agent, or Firm* — Hanley, Flight & Zimmerman, LLC

(57) ABSTRACT

Tasting flight kits are disclosed herein. An example tasting flight kit includes a drinking cup and a tray to support the drinking cup. The tray includes a base and an opening extending through the base. The opening has a larger diameter than a bottom portion of the drinking cup, such that when the drinking cup is inserted into the opening from a top side of the base, the bottom portion of the drinking cup extends through the opening and beyond a bottom side of the base. The example tasking flight kit also includes a ring having an outer diameter larger than a diameter of the opening. The ring is to be placed around the bottom portion of the drinking cup when the drinking cup is inserted into the opening to prevent the drinking cup from being removed from the opening when the tray is inverted.

20 Claims, 9 Drawing Sheets

TASTING FLIGHT KITS

FIELD OF THE DISCLOSURE

This disclosure relates generally to tasting flights and, more particularly, to tasting flight kits.

BACKGROUND

Tasting flights provide users with an organized way to try a selected variety of beverages such as wines or spirits. These tasting flights can include components such as drinking cups and a holder or tray for supporting and/or carrying the drinking cups. This enables tasters to sample a curated set of beverages while being portable for on-demand use and transport.

SUMMARY

This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented in this disclosure.

An example tasting flight kit disclosed herein includes a drinking cup and a tray to support the drinking cup. The tray includes a base with a top side and a bottom side opposite the top side. An opening extends through the base between the top side and the bottom side. The opening has a larger diameter than a bottom portion of the drinking cup, such that when the drinking cup is inserted into the opening from the top side, the bottom portion of the drinking cup extends through the opening and beyond the bottom side. The example tasting flight kit also includes a ring having an outer diameter larger than a diameter of the opening. The ring is to be placed around the bottom portion of the drinking cup when the drinking cup is inserted into the opening to prevent the drinking cup from being removed from the opening when the tray is inverted.

Another example tasting flight kit disclosed herein includes a first drinking cup having first indicia and a second drinking cup having second indicia that is different than the first indicia. The example tasting flight kit includes a tray to support the first drinking cup and the second drinking cup. The example tasting flight kit also includes a first bottle tag including a first ring and a first tab coupled to the first ring. The first tab has first indicia that matches the first indicia on the first drinking cup. The example tasting flight kit further includes a second bottle tag including a second ring and a second tab coupled to the second ring. The second tab has second indicia that matches the second indicia on the second drinking cup.

Figure 1:
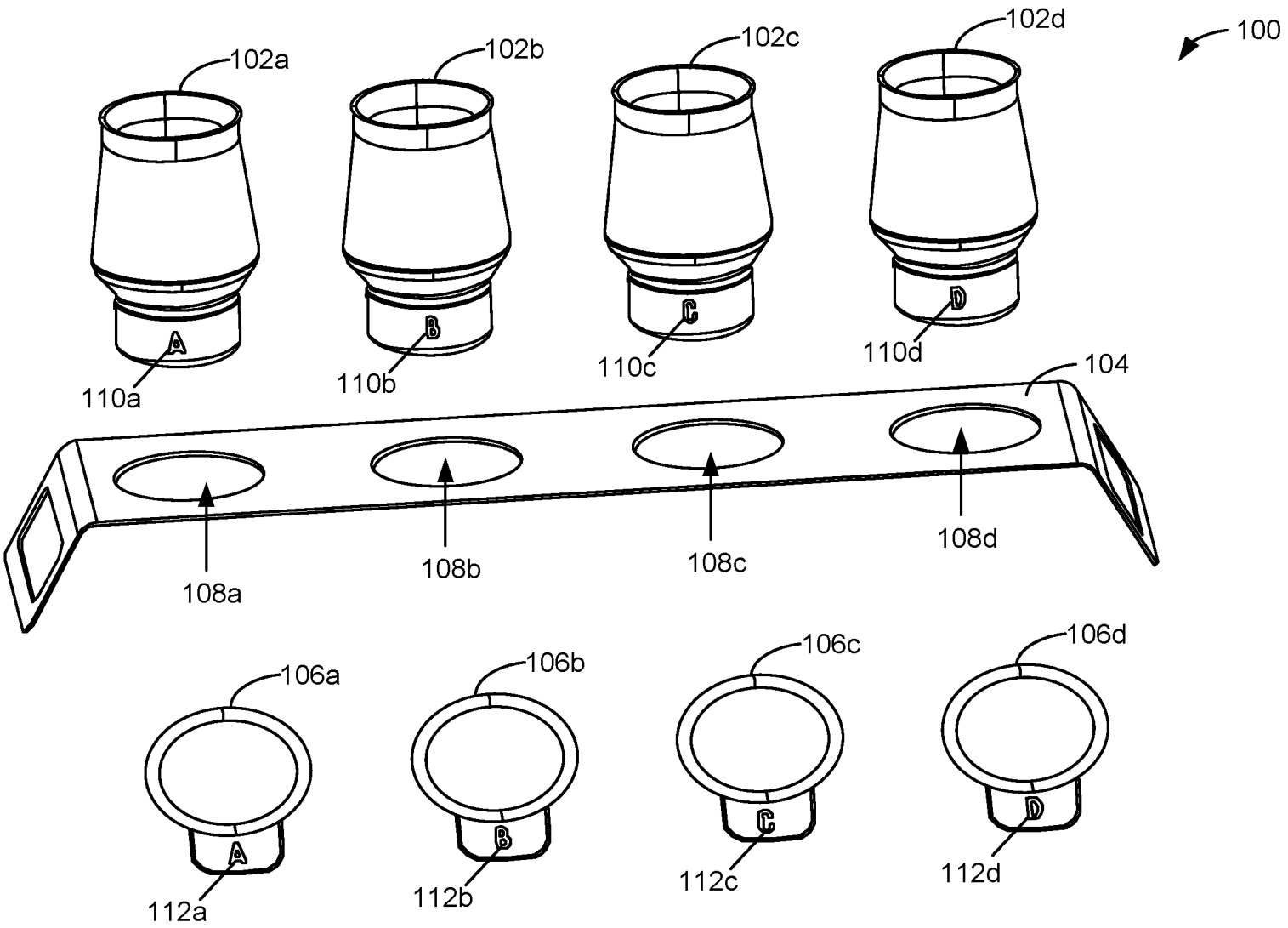
FIG. 1 illustrates an example tasting flight kit including an example set of drinking cups, an example tray, and an example set of bottle tags.

The figures are not to scale. In general, the same reference numbers will be used throughout the drawing(s) and accompanying written description to refer to the same or like parts. As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc. are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, "approximately" and "about" refer to dimensions that may not be exact due to manufacturing tolerances and/or other real world imperfections.

DETAILED DESCRIPTION

Tasting flight sets or kits offer users an opportunity to sample a variety of beverages, typically spirits, wines, beers, and/or liquors, for example. Tasting flight kits can also be used for non-alcoholic beverages. These tasting flight kits allow for curating and organizing an array or flight of beverages depending on a user's or server's preferences. Tasting flight kits often include a set of cups and a holder or board for transporting the cups. A person (e.g., a curator, a server, a bartender, etc.) can pour samples of various beverages into the cups and then transport the tray with the cups to a taster. The cups can be removed from the holder and rearranged as desired by the taster. In some instances, tasting flight kits are used for blind taste testing in which the taster does not know which sample corresponds to which brand or maker of the sample. However, these known sets or kits have shortcomings that limit convenience in use, storage, and portability and are cumbersome to handle. For example, it is often difficult to track or remember which beverage was poured into which cup because tasters often remove the cups from tray and move the cups around while tasting. Therefore, tasters and curators may not be able to accurately track which beverages the person enjoyed. Also, when transporting the holder with the cups, the cups are often unstable and prone to tipping and spilling. Further, when the tasting flight kit is not being used, the cups and holder are often stored separately and, thus, are prone to being misplaced and/or broken.

Disclosed herein are example tasting flight sets or kits that address at least some of the above-noted drawbacks. Some example tasting flight kits disclosed herein include a set of drinking cups, a tray, and a set of bottle tags. In some examples, each of the drinking cups has a specific indicia (e.g., the letter "A", "B", etc.), and each of the bottle tags has indicia that matches one of the drinking cups. The bottle tags can be placed around the bottles (e.g., around the necks of the bottles) of the beverages that are poured into the respective drinking cups, thereby enabling a person to keep track of which beverage corresponds to which drinking cup. This is especially beneficial during blind taste tasting. Thus, the example tasting flight kit can facilitate pairing between each drinking cup and each beverage bottle via the bottle tags.

In some examples, the example tasting flight kits disclosed herein can enable safer transport of the tray with the drinking cups by using the bottle tags to secure the drinking cups to the tray to avoid or prevent spillage and/or a cup falling out of the tray. For example, the drinking cups may be set in corresponding openings in the tray. Then, the bottle tags can be placed around the bottom portions of the drinking cups on the bottom side of the tray. This prevents the drinking cups from falling out of the openings should the tray be tilted or inverted. This arrangement can address the storage limitations of known tasting sets. Specifically, known tasting sets can be bulky to store as they include multiple components that are stored separately. The example tasting flight kits presented herein can secure the drinking cups to the tray, and then the tray can be hung vertically (e.g., from a hook on a wall). As such, the entire tasting flight kit is kept together in a compact, space-reducing arrangement.

Turning now to the figures, FIG. 1 illustrates an example tasting flight kit 100 constructed in accordance with the teachings of this disclosure. The example tasting flight kit 100 can be used to taste and/or sample one or more beverages. While many of the examples disclosed herein are described in connection with tastings for alcoholic beverages, it is understood that any of the example tasting flight kits disclosed herein can also be used with tastings for non-alcoholic beverages. Further, the example tasting flight kits could be used for testing or viewing of non-consumable liquids, such as chemicals, oil, cleaning liquids, etc.

In the illustrated example, the example tasting flight kit 100 includes a set of drinking cups 102*a*, 102*b*, 102*c*, and 102*d*, a tray 104 to support the drinking cups 102*a*-102*d*, and a set of bottle tags 106*a*, 106*b*, 106*c*, and 106*d*. In this example, the tasting flight kit 100 includes four drinking cups 102*a*-102*d*, which can also be referred to as containers or vessels. In other examples, the tasting flight kit 100 can include more or fewer drinking cups (e.g., one drinking cup, two drinking cups, three drinking cups, five drinking cups, six drinking cups, etc.). The drinking cups 102*a*-102*d* can be used to drink various beverages. For example, four different beverages (e.g., beers, wines, etc.) can be poured into the four different drinking cups 102*a*-102*d* and used to taste the different beverages.

The tray 104 can be used to support, transport, and/or store the drinking cups 102*a*-102*d*. In this example, the tray 104 has four openings 108*a*, 108*b*, 108*c*, and 108*d* that can be used to support the drinking cups 102*a*-102. The drinking cups 102*a*-102*d* can be inserted into the openings 108*a*-108*d* and supported by the tray 104 as shown in further detail herein. The drinking cups 102*a*-102*d* can be placed in the openings 108*a*-108*d* in any order or arrangement. In other examples, the tray 104 can include a different number of openings (e.g., one, two, three, five, six, etc.).

In the illustrated example, the tasting flight kit 100 includes four bottle tags 106*a*-106*d*, whereas other examples can include other numbers of bottle tags (e.g., one, two, three, five, six, etc.). In this example, the tasting flight kit 100 includes the same number of drinking cups 102*a*-102*d* as bottles tags 106*a*-106*d*. The bottle tags 106*a*-106*d* correspond to the respective ones of the drinking cups 102*a*-102*d* and can be used to identify which beverage is in which drinking cup 102-102*d*.

For example, as shown in FIG. 1, the drinking cups 102*a*-102*d* include indicia 110*a*, 110*b*, 110*c*, and 110*d*. In this example, the indicia 110*a*-110*d* includes majuscule alphabetical letters A, B, C, and D. For example, the first drinking cup 102*a* includes the first indicia 110*a*, which is the letter A, the second drinking cup 102*b* includes the second indicia 110*b*, which is the letter B, the third drinking cup 102*c* includes the third indicia 110*c*, which is the letter C, and the fourth drinking cup 102*d* includes the fourth indicia 110*d*, which is the letter D. In this example, the indicia 110*a*-110*d* are etched onto the outer surfaces of the drinking cups 102*a*-102*d* (e.g., laser etched into the glass material of the drinking cups 102*a*-102*d*). In other examples, the indicia 110*a*-110*d* can be written, stamped, and/or otherwise coupled to the respective drinking cups 102*a*-102*d* (e.g., an adhesive sticker applied to the outer surface). Similarly, the example bottle tags 106*a*-106*d* include indicia 112*a*, 112*b*, 112*c*, and 112*d* that match the indicia 110*a*-110*d* on corresponding ones of the drinking cups 102*a*-102*d*. For example, the first bottle tag 106*a* has the first indicia 112*a* of the letter A, which matches the first indicia 110*a* on the first drinking cup 10*a*. As such, the first bottle tag 106*a* corresponds to the first drinking cup 102*a*. The second, third, and fourth bottle tags 106*b*, 106*c*, 106*d* similarly correspond to the second, third, and fourth drinking cups 102*b*, 102*c*, 102*d*.

Figure 2:
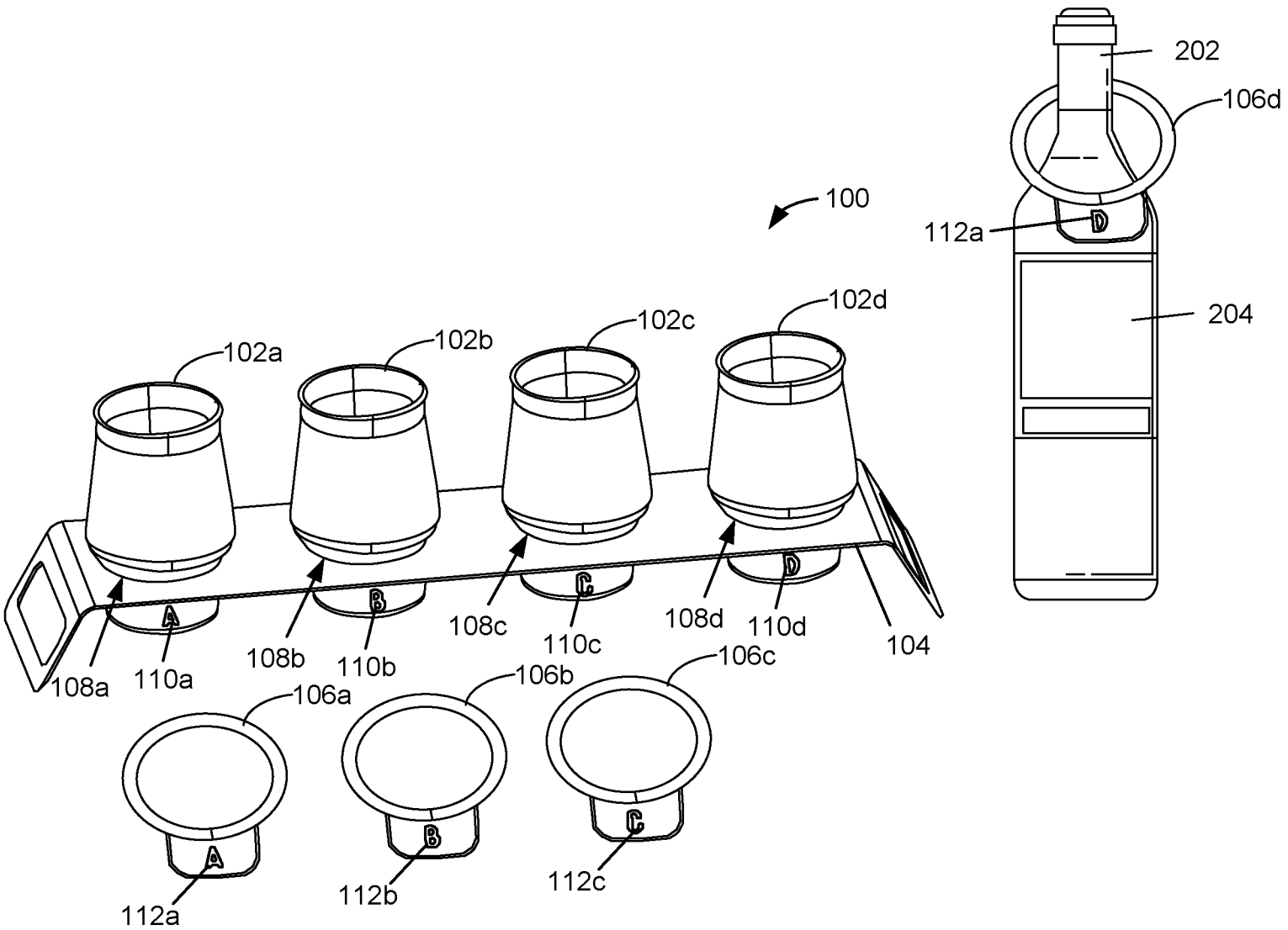
FIG. 2 illustrates the example tasting flight kit of FIG. 1 with the example set of drinking cups disposed on the tray and one of the example bottle tags disposed around a neck of an example bottle.

FIG. 2 shows the example tasting flight kit 100 of FIG. 1 with the drinking cups 102*a*-102*d* disposed in the openings 108*a*-108*d*, respectively, of the tray 104. The tray 104 can be used to transport and/or serve the drinking cups 102*a*-102*d* to a taster. Before or after pouring beverages into the drinking cups 102*a*-102*d*, the corresponding bottle tag 106*a*-

106*d* can be placed around the neck of the container/bottle of the beverage so as to track which beverage is in which of the drinking cups 102*a*-102*d*. For example, as shown in FIG. 2, the fourth bottle tag 106*d* has been disposed around a neck 202 of a bottle 204 as can be used in a taste testing scenario. The example bottle 204 can be a bottle of any liquid (e.g., spirit, wine, juice, etc.). In this example, the fourth bottle tag 106*d* with the indicia 'D' is disposed around the neck 202 of the bottle 204 to indicate that the contents of bottle 204 corresponds to the contents of the fourth drinking cup 102*d* labelled with the corresponding indicia 'D'. The other bottle tags 106*a*-106*c* can be similarly placed around bottles of beverages that are poured into the corresponding drinking cups 102*a*-102*c*. As such, when multiple beverages bottles are used in a taste testing scenario, the bottle tags 106*a*-106*d* disposed can identify the contents in each corresponding drinking cups 102*a*-102*d* to enable a person to easily identify which beverage is in each of the drinking cups 102*a*-102*d*.

The example tasting flight kit 100 can also be used for blind taste testing. For example, a person can pour four different beverages into the four drinking cups 102*a*-102*d*. The person can place the bottle tags 106*a*-106*d* around the bottles (or place them near the bottles) that correspond to the contents poured in each of the drinking cups 102*a*-102*d*. In some examples, the bottle tags 106*a*-106*d* can even be placed face-down on the bottles, such that the person cannot see the indicia 112*a*-112*d* on the bottle tags 106*a*-106*d* while the person is tasting the beverages. Then, the person can turn the drinking cups 102*a*-102*d* backward such that the person cannot see the indicia 110*a*-110*d* on the drinking cups 102*a*-102*d*. The person can even move the drinking cups 102*a*-102*d* around to change the order. After the person tastes the different beverages in the drinking cups 102*a*-102*d*, the person can match up the drinking cups 102*a*-102*d* with the corresponding bottle tags 106*a*-106*d* to identify which beverage was in which of the drinking cups 102*a*-102*d*.

Figure 3A:
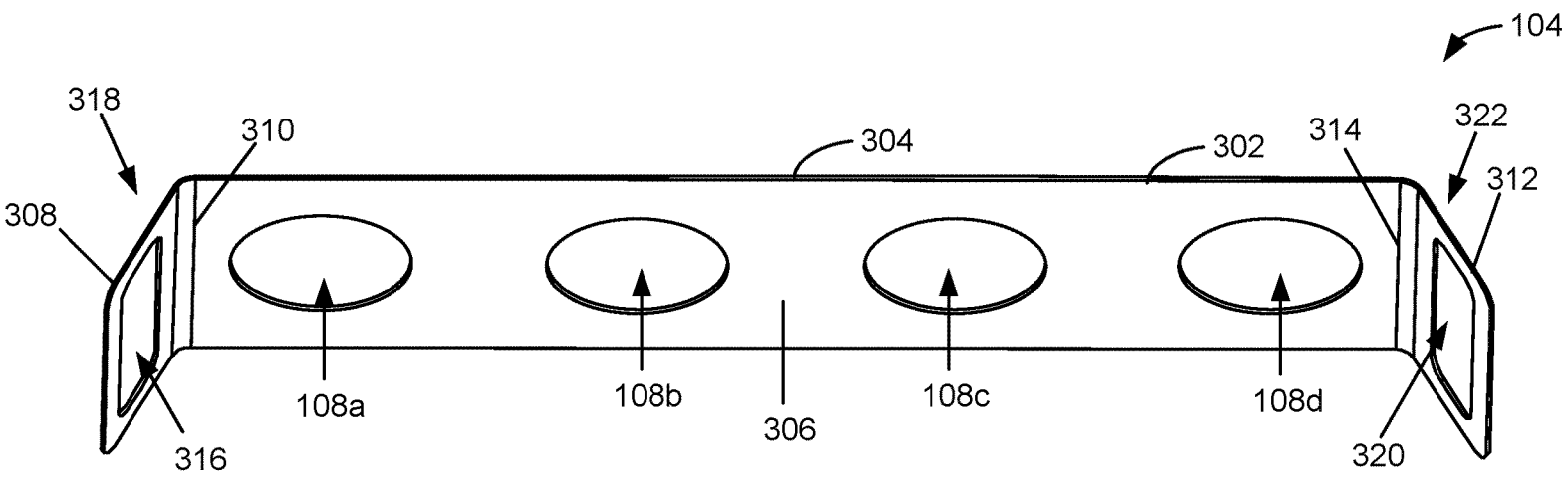
FIG. 3A is a bottom perspective view of the example tray of the example tasting flight kit of FIG. 1.
Figure 3B:
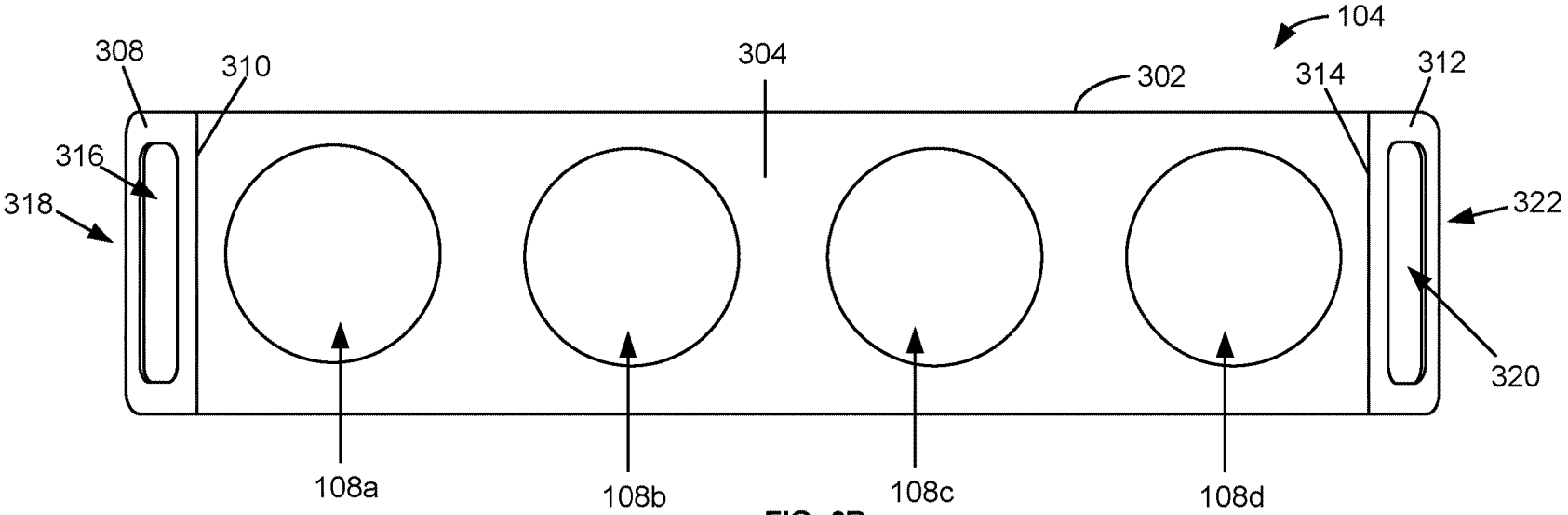
FIG. 3B is a top view of the example tray of the example tasting flight kit of FIG. 1.

FIG. 3A is a bottom perspective view of the example tray 104, and FIG. 3B is a top view of the example tray 104. In the illustrated example, the tray 104 includes a base 302 with a top side 304 and a bottom side 306 opposite the top side 304. The openings 108*a*-108*d* of the example tray 104 extend through the base 302 between the top side 304 and the bottom side 306. In this example, the example openings 108*a*-108*d* are circular. In other examples, the openings 108*a*-108*d* can be shaped differently (e.g., square, polygonal, triangular, etc.) to accept drinking cups of analogous or different shapes.

In the illustrated example, the tray 104 includes a first leg 308 coupled to and extending from the base 302 at a first end 310, and a second leg 312 coupled to and extending from the base 302 at a second end 314, where the second end 314 is opposite the first end 310. The first and second legs 308, 312 support the base 302 above a support surface (e.g., a table, a counter, a bar top, etc.) when the tray 104 is placed on the support surface and rests on the legs 308, 312. Therefore, the drinking cups 102*a*-102*d* can be elevated from the support surface when disposed in the respective openings 108*a*-108*d*. In this example, the openings 108*a*-108*d* are spaced equidistant from each other between the first and second ends 310, 314. However, in other examples, the openings 108*a*-108*d* can be spaced differently.

In the illustrated example, the legs 308, 312 are angled relative to the base 302. In this example, the legs 308, 312 are angled at about 60° (e.g., ±5°) relative to the base 302. However, in other examples, the legs 308, 312 can be angled greater than or less than 60° relative to the base 302. In some examples, the first and second legs 308, 312 can be perpendicular (e.g., 90°) relative to the base 302.

In some examples, to help with carrying the tray 104, the tray 104 may include one or more handles. For example, as shown in FIGS. 3A and 3B, the first leg 308 has a first opening 316 forming a first handle 318 and the second leg 312 has a second opening 320 forming a second handle 322. For example, a person can grip one end of the tray 104 by inserting one hand (or fingers) through the first opening 316 and their other hand (or fingers) through the second opening 320. As such, the person does not need to wrap his/her fingers under the ends of the legs 308, 312. This prevents or reduces the risk of tipping the tray 104 because the person's fingers do not need to be placed under the ends of the legs 308, 312 when lifting the tray 104 or setting the tray 104 down on a support surface. In this example, the openings 316, 320 are rectangular in shape, whereas in other example the openings 316, 320 can be different shapes such as circular, or polygonal, for example. The first and second handles 318, 322 can be used to carry, hold, and or store the tray 104. However, in other examples, the first and second legs 308, 312 may not have respective openings 316, 320 to form a first and/or second handle 318, 322.

In some examples, the tray 104, including the base 302 and the legs 308, 312, is constructed of a single unitary part or component (e.g., a monolithic structure). In other examples, the tray 104 can be constructed of multiple parts where the base 302 and/or each of the legs 308, 312 can be coupled together. In some examples, the tray 104 is constructed of aluminum. Additionally or alternatively, the tray 104 can be constructed of other materials (e.g., stainless steel, iron, plastic, plexiglass, etc.). In some examples, the example tray 104 has a powder-coated. In other examples, the tray 104 can have a different surface finish (e.g., metal plating, blasting, polishing, buffing, etc.) or no surface finish.

Figure 4:
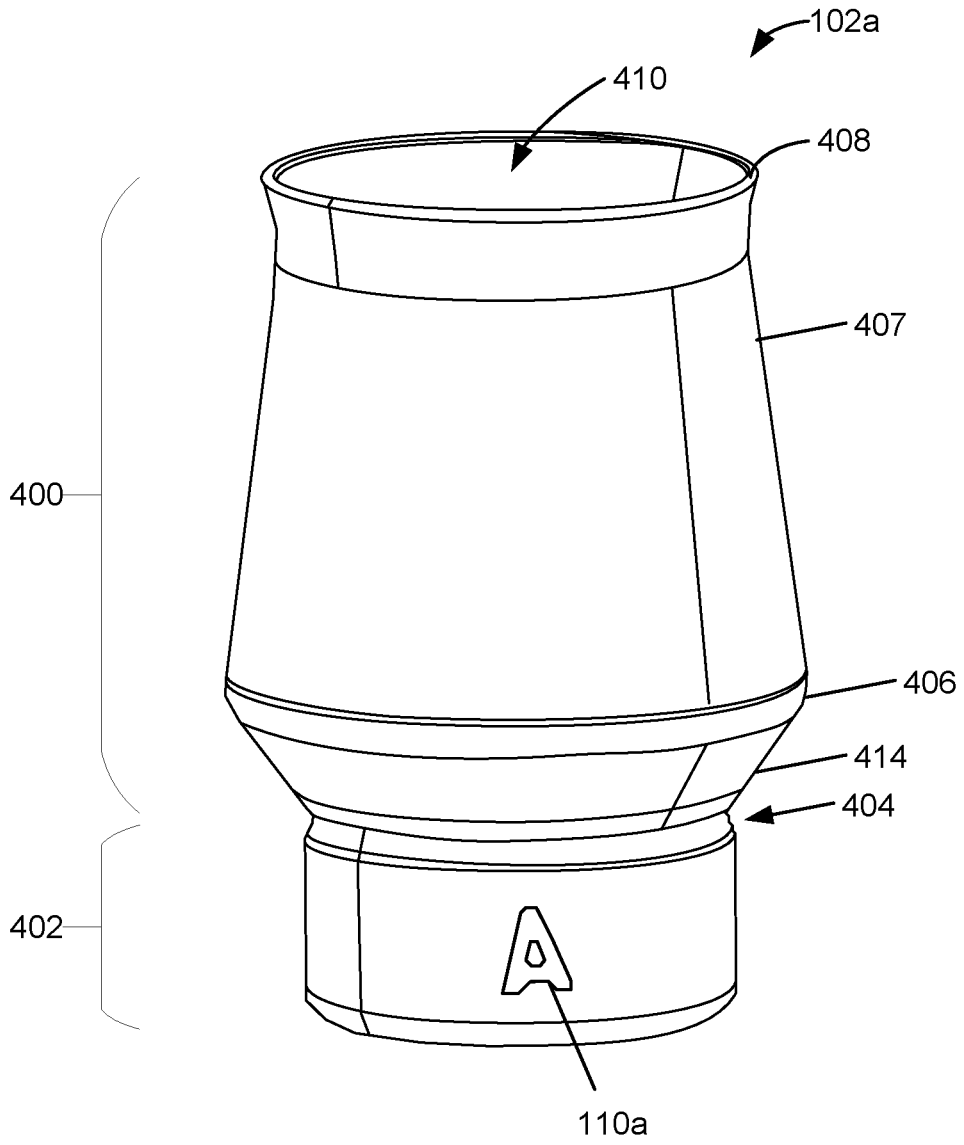
FIG. 4 is a perspective view of one of the example drinking cups of the example tasting flight kit of FIG. 1.

FIG. 4 is a perspective view of the first drinking cup 102*a* of the example tasting flight kit 100. The second, third, and fourth drinking cups 102*b*-102*d* (FIG. 1) can be identical to the first drinking cup 102*a*. Thus, any of the example aspects disclosed in connection with the first drinking cup 102*a* can likewise apply to the second, third, and fourth drinking cups 102*b*-102*d*.

In the illustrated example, the first drinking cup 102*a* includes an upper portion 400 (a first portion) and a bottom portion 402 (a second portion). The bottom portion 402 defines a base of the first drinking cup 102*a*. When the first drinking cup 102 is inserted into one of the openings 108*a*-108*d* (FIG. 1), the bottom portion 402 extends through the opening, as shown in further detail herein. The upper portion 400 has a larger diameter than the opening, which, as a result, engages (e.g., contacts) the tray 104 and thereby supports the first drinking cup 102*a* on the tray 104. As shown in FIG. 4, the upper portion 400 of the first drinking cup 102*a* has an enlarged portion 406 forming a largest diameter of the first drinking cup 102*a*. In some examples, the enlarged portion 406 corresponds to one fluid ounce within the first drinking cup 102*a*. This is advantageous as it can be used to easily identify how much liquid is poured into the first drinking cup 102*a* (e.g., a person can stop pouring when the liquid reaches the enlarged portion 406 to ensure the first drinking cup 102 contains one fluid once). In other examples, the enlarged portion 406 can correspond to a different volume of liquid (e.g., one-half fluid ounce, two fluid ounces, etc.). In the illustrated example, the first drinking cup 102*a* has a first tapered section 407 that decreases in diameter moving upward from the enlarged portion 406. The first drinking cup 102*a* has a lip 408 defining an opening 410 in the first drinking cup 102*a*. In this example, the lip 408 of the first drinking cup 102*a* is flared outward. In the illustrated example, the first drinking cup 102*a* has a second tapered section 414 that decreases in diameter moving downward from the enlarged portion 406 toward the bottom portion 402. As such, the bottom portion 402 of the example drinking cup 102*a* has a smaller diameter than at least a portion of the upper portion 400.

As disclosed above in connection with FIGS. 1 and 2, the first drinking cup 102*a* includes the first indicia 110*a*. In this example, the first indicia 110*a* is disposed on (e.g., etched into) the bottom portion 402 of the first drinking cup 102*a*. In other examples, the indicia 110*a* can be disposed on the upper portion 400 of the first drinking cup 102*a* or another location on the first drinking cup 102*a*. In some examples, the first drinking cup 102*a* is constructed of glass, such as lead-free crystal glass. In other examples, the first drinking cup 102*a* can be constructed of a different material (e.g., plastic, ceramic, aluminum, stainless steel, crystal, etc.).

In some examples, the first bottle tag 106*a* (FIG. 1) can be placed around a portion of the first drinking cup 102*a* to help secure the first drinking cup 102*a* to the tray 104 (FIG. 1). In some such examples, the first drinking cup 102 may include a groove to receive the first bottle tag 106*a*. For example, as shown in FIG. 4, the first drinking cup 102*a* has a groove 404 to receive the first bottle tag 106*a* (FIG. 1). In the illustrated example, the groove 404 is located on the bottom portion 402 near the upper portion 400. The example groove 404 is a concaved surface surrounding the first drinking cup 102*a*.

Figure 5:
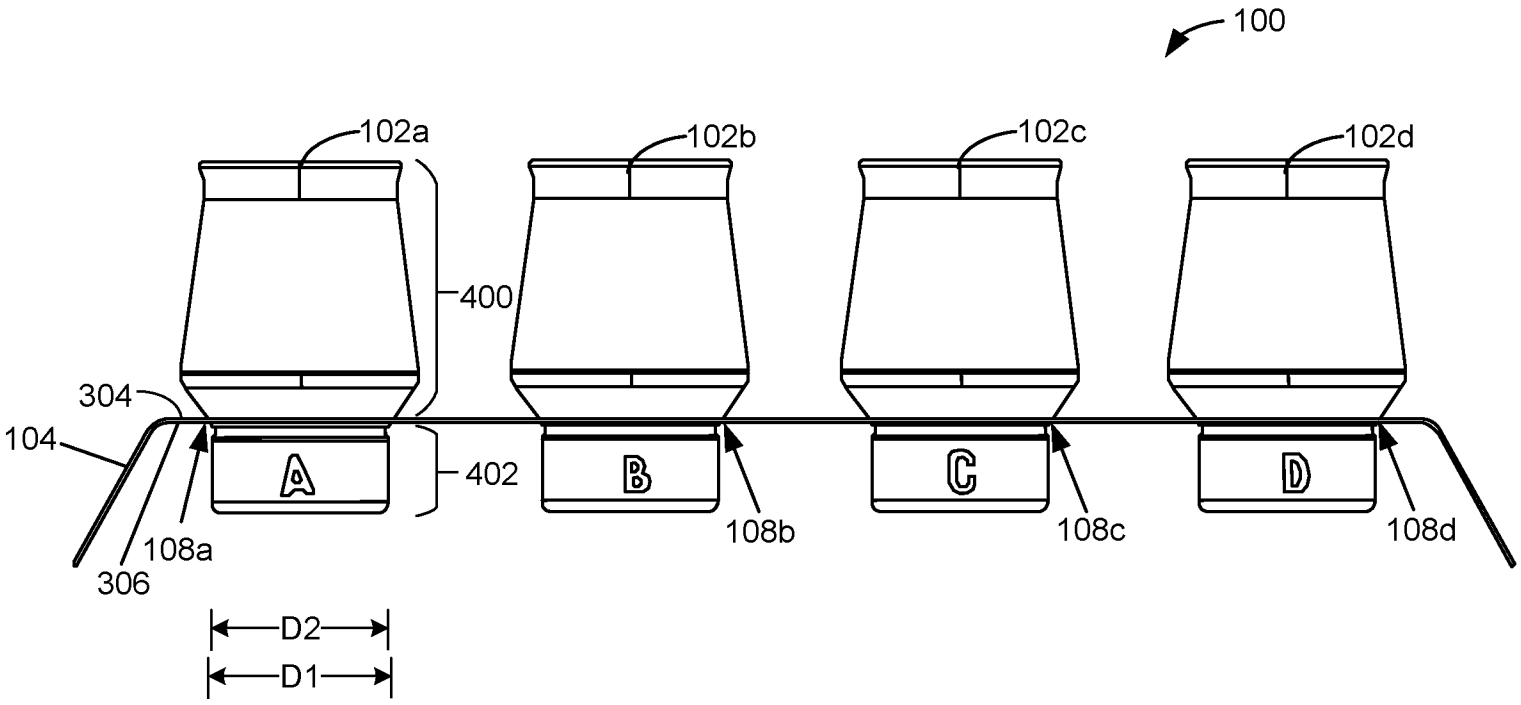
FIG. 5 is a side view of the example tasting flight kit of FIG. 1 with the example drinking cups disposed on the example tray.

FIG. 5 is a side view of the example tasting flight kit 100 of FIG. 1 with the drinking cups 102*a*-102*d* disposed in the respective openings 108*a*-108*d* in the tray 104. In the illustrated example, the first opening 108*a* has a diameter D1 that is larger than a diameter D2 of the bottom portion 402 of the first drinking cup 102*a*. As such, when the first drinking cup 102*a* is inserted into the first opening 108*a* from the top side 304 of the tray 104, the bottom portion 402 extends through the first opening 108*a* and beyond the bottom side 306 of the tray 104. As illustrated in FIG. 5, the upper portion 400 of the first drinking cup 102*a* has a larger diameter than the diameter D2 of the first opening 108*a* of the tray 104. As such, the upper portion 400 of the first drinking cup 102*a* (e.g., the second tapered section 414 (FIG. 4)) engages an inner peripheral edge of the tray 104 forming the first opening 108*a*, thereby supporting the first drinking cup 102*a* on the tray 104. The second, third, and fourth openings 108*b*-108*d* have a similar arrangement with the second, third, and fourth drinking cups 102*b*-102*d*. In this manner, the drinking cups 102*a*-102*d* can rest in the tray 104 during transport, for example, without falling through the openings 108*a*-108*d*. This arrangement is also more stable than balancing the drinking cups 102*a*-102*d* on their bottoms on the top side 304 of the tray 104.

Figure 6A:
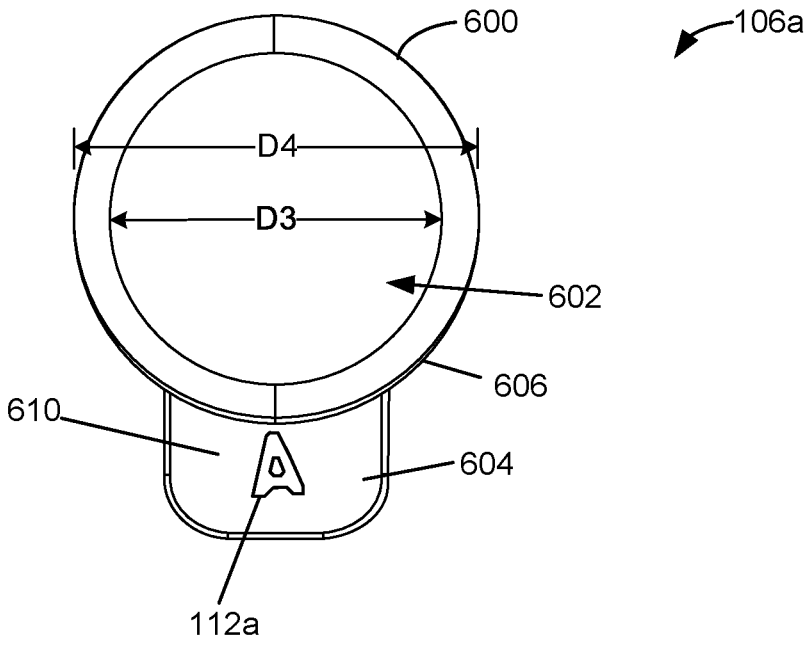
FIGS. 6A and 6B are top and side views, respectively, of one of the example bottle tags of FIG. 1.
Figure 6B:
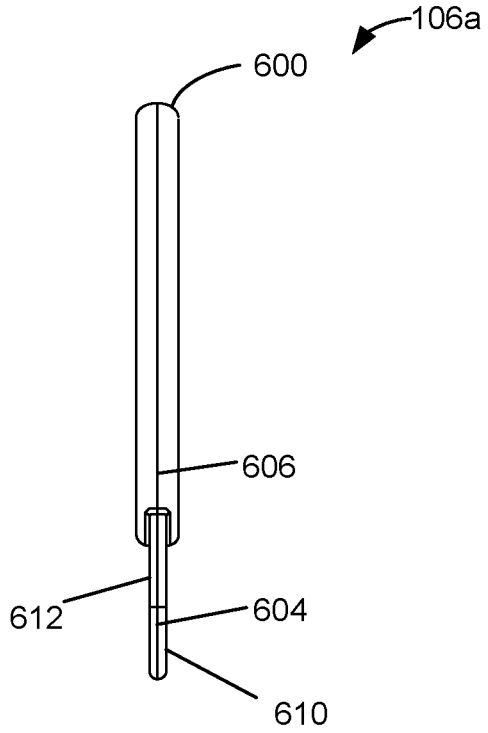

FIGS. 6A and 6B are top and side views, respectively, of the first example bottle tag 106*a*. The second, third, and fourth bottle tags 106*b*-106*d* can be identical to the first bottle tag 106 (except, for example, for the different indicia). Therefore, any of the example aspects disclosed in connection with the first bottle tag 106*a* can likewise apply to the second, third, and fourth bottle tags 106*b*-106*d*.

In the illustrated example, the first bottle tag 106*a* includes a ring 600. The ring 600 defines an opening 602. The ring 600 can be placed around a neck of a bottle or container (e.g., the bottle 204 of FIG. 2) to hang the first bottle tag 106*a* on the bottle or container. In the illustrated example, the ring 600 is circular. In other examples, the ring 600 can be shaped differently (e.g., square shaped, triangular shaped, etc.).

In the illustrated example, the first bottle tag 106*a* includes a tab 604 coupled to and extending from an outer edge 606 of the ring 600. The example tab 604 is rectangular shaped. However, in other examples, the tab 604 can be shaped differently (e.g., triangular, polygonal, etc.). In this example, the tab 604 has the first indicia 112*a*, corresponding to the first indicia 110*a* (FIG. 1) on the first drinking cup 102*a* (FIG. 1). In some examples, the first indicia 112*a* is embossed (e.g., raised or recessed) on a first outer surface 610 of the tab 604 whereas in other examples, the first indicia 112*a* can be printed, stamped, laser cut, engraved, pressed, and/or otherwise coupled to the first outer surface 610 of the tab 604. In some examples, a second indicia can be embossed on a second outer surface 612 (FIG. 6B) of the tab 604, where the second outer surface 614 is opposite the first outer surface 610 of the tab 604. The second indicia can include a branding logo, or a secondary indicator such as a number, symbol, and/or sign, for example. In other examples, the second outer surface 612 of the tab 604 can be blank and have no indicia. In some examples, such as during a blind taste test, the first bottle tag 106*a* can be placed on a bottle with that the first outer surface 610 (and the first indicia 112*a*) facing downward. As such, the taster would not be able to see which bottle corresponds to which of the drinking cups 102*a*-102*d* (FIG. 1).

In some examples, the ring 600 and the tab 604 are constructed of a single unitary part or component (e.g., a monolithic structure). In other examples, the ring 600 and the tab 604 can be separate parts or components that are coupled together (e.g., via bonding, adhesive, fusion, etc.). In some examples, the first bottle tag 106*a*, including the ring 600 and the tab 604, are constructed of a compliant material such as silicone. Therefore, the ring 600 may be flexible or elastic and can be expanded or stretched. Additionally or alternatively, the ring 600 and/or the tab 604 can be constructed of other materials such as rubber, plastic, etc.

In some examples, the first bottle tag 106*a* can be placed around the bottom portion 402 (FIG. 4) of the first drinking cup (FIG. 1) when the first drinking cup 102*a* is inserted into the first opening 108*a* (FIG. 1) to secure the first drinking cup 102 to the tray 104 (FIG. 1). As shown in FIG. 6A, the ring 600 has an inner diameter D3 and outer diameter D4. In some examples, the ring 600 is sized such that the outer diameter D4 is larger than the diameter D1 (FIG. 5) of the first opening 108*a* (FIG. 1). As such, when the ring 600 is disposed around the bottom portion 402 of the first drinking cup 102*a* when the first drinking cup 102*a* is inserted into the first opening 108*a*, the ring 600 prevents the first drinking cup 102 from being removed from the first opening 108*a* when the tray 104 is inverted, moved, and/or stored. In some examples, the ring 600 can be placed in the groove 404 (FIG. 4) of the first drinking cup 102*a*. In some examples, the ring 600 is constructed of compliant material, such the ring 600 can be stretched (e.g., expanded) over the bottom portion 402 of the first drinking cup 102 and released into the groove 404. The ring 600 contracts around the bottom portion 402 of the first drinking cup 102*a*, thereby securing itself to the first drinking cup 102*a*. In some examples, the outer diameter D4 of the ring 600 is larger than the diameter D1 of the opening 108*a* when the ring 600 is in a relaxed or unstretched state. In other examples, the outer diameter D4 of the ring 600 may be less than the diameter D1 of the opening 108*a* when the ring 600 is in a relaxed or unstretched state. However, when the ring 600 is stretched and placed around the bottom portion 402 of the first drinking cup 102, the outer diameter D4 of the ring 600 is larger than the diameter D1 of the opening 108*a*.

Figure 7:
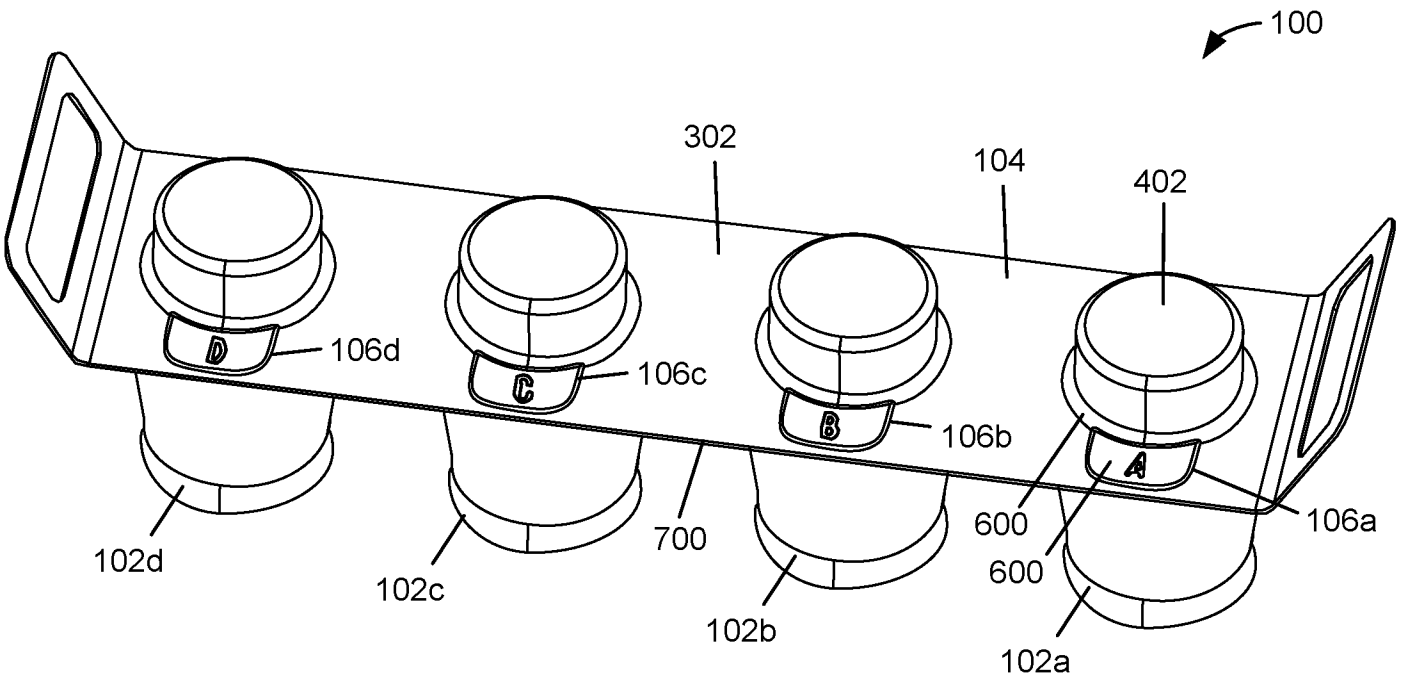
FIG. 7 is a bottom perspective view of the example tasting flight kit of FIG. 1 with the example drinking cups on the tray and the example bottle tags disposed on the example drinking cups.

FIG. 7 is a bottom perspective view of the example tasting flight kit 100 of FIG. 1 showing the drinking cups 102*a*-102*d* inserted into the openings 108*a*-108*d* (FIG. 1) in the tray 104 and the bottle tags 106*a*-106*d* secured to the respective drinking cups 102*a*-102*d*. In the illustrated example, the rings 600 of the first bottle tag 106*a* is placed in the groove 404 (FIG. 4) around the bottom portion 402 of the first drinking cup 102*a*. As disclosed above, the outer diameter D4 (FIG. 6) of the ring 600 is larger (or stretched to a larger diameter) than the diameter D1 (FIG. 5) of the first opening 108*a* (FIG. 1). This prevents the first drinking cup 102*a* from being removed from the opening 108*a*. As such, the ring 600 of the first bottle tag 106*a* couples the first drinking cup 102*a* to the base 302 of the tray 104 at the respective opening 108*a*. As explained above, coupling the first drinking cup 102*a* to the base 302 of the tray 104 prevents the first drinking cup 102*a* from disengaging from the tray 104 and being removed from the opening 108*a* when the tray 104 is inverted, transported, stored, or moved. The other drinking cups 102*b*-102*d* are similarly coupled to the tray 104 via the bottle tags 106*b*-106*d*. To remove the drinking cups 102*a*-102*d* from the tray 104, a person can pull (e.g., by gripping the tabs) the bottle tags 106*a*-106 off of the bottom portions of the respective drinking cups 102*a*-102*d*.

In the illustrated example, the tab 604 of the first bottle tag 106*a* is dimensioned such that when the ring 600 is placed around the bottom portion 402 of the first drinking cup 102*a*, the tab 604 does not extend beyond an edge 700 of the base 302 of the tray 104. As such, when the assembled tasting flight kit 100 is stored, the tab 604 of the first bottle tag 106*a* does not cause the tasting flight kit 100 to take up additional space than the width of the tray 104, thus providing a compact storage solution. The other tabs of the other bottle tags 106*b*-106*d* are similarly sized.

Figure 8:
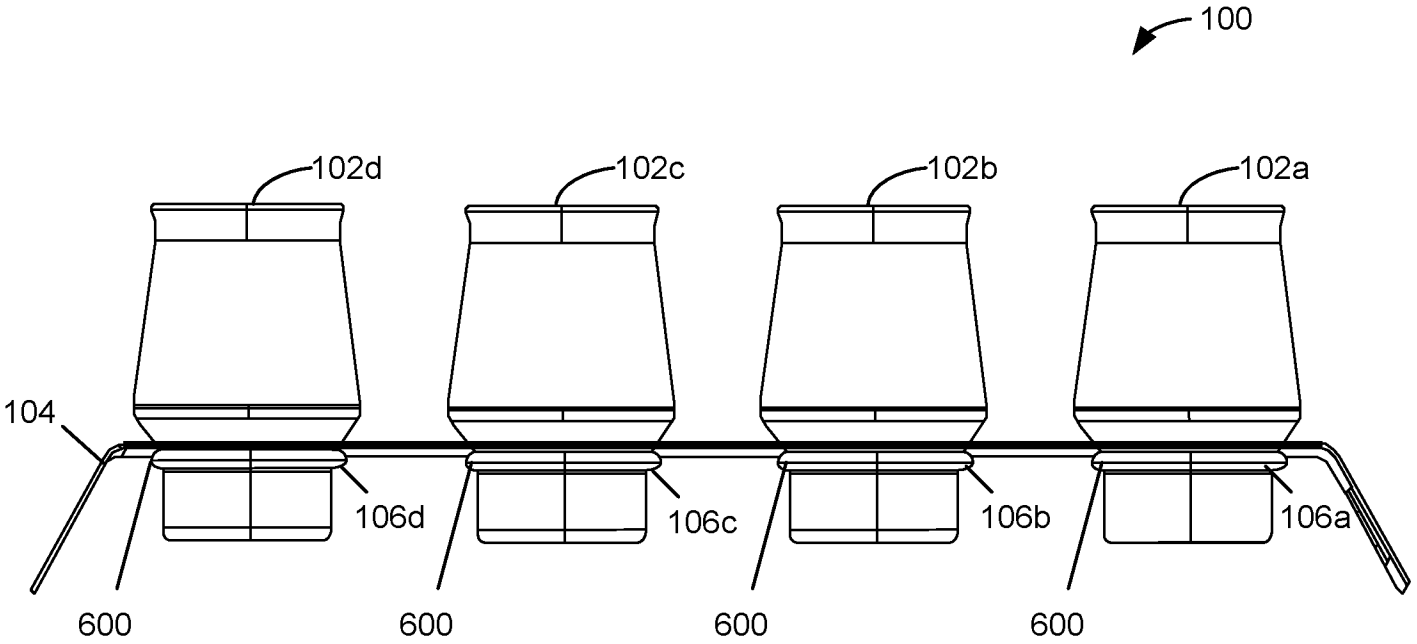
FIG. 8 is side view of the example tasting flight kit of FIG. 7.

FIG. 8 is a side view of the example tasting flight kit 100 of FIG. 7 including the drinking cups 102*a*-102*d* coupled to the base 302 of the tray 104 at each opening 108*a*-108*d* (FIG. 1) via the rings 600 the bottle tags 106*a*-106*d*.

Figure 9:
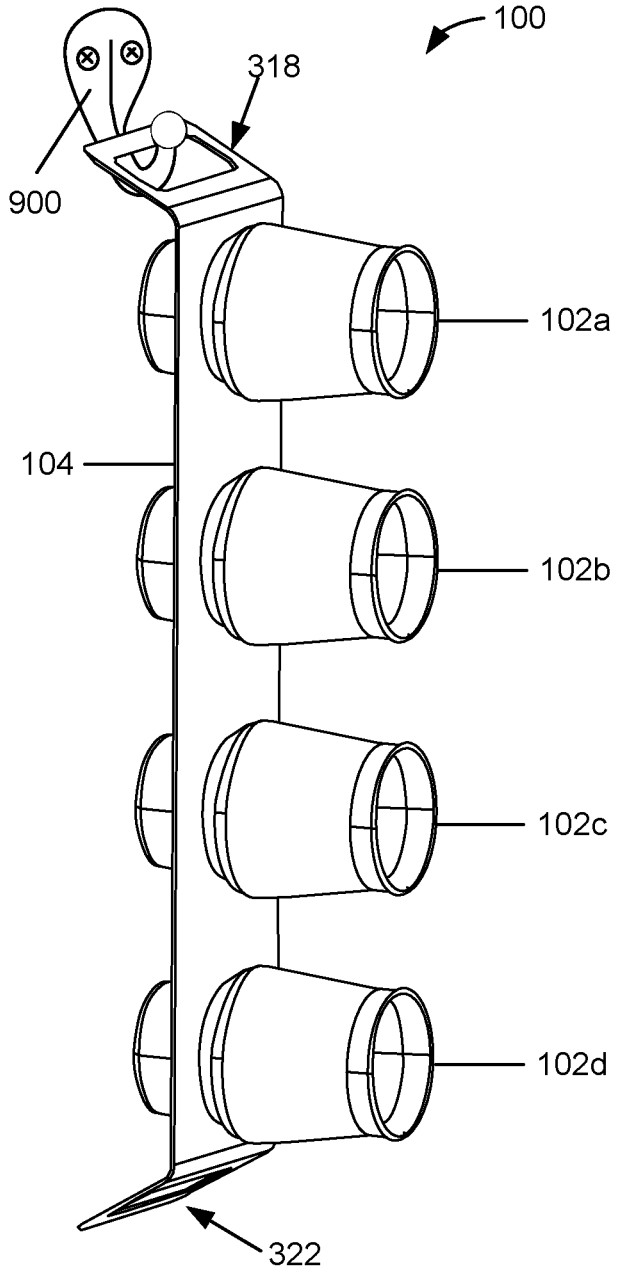
FIG. 9 shows the example tasting flight kit of FIG. 7 hung vertically from an example hook by an example handle of the example tray.

FIG. 9 shows the example tasting flight kit 100 of FIG. 7 with the drinking cups 102*a*-102*d* secured to the tray 104 (e.g., via the bottle tags 106*a*-106*d* as shown in FIGS. 7 and 8). The tray 104 (along with the drinking cups 102*a*-102*d* and the bottle tags 106*a*-106*d*) can be hung vertically for storage. For example, as shown in FIG. 9, the tray 104 is hung vertically from a hook 900 by the handle 318. In other examples, the example tasting flight kit 100 can be hung by the second handle 322 of the tray 104. In other examples, the tasting flight kit 100 can be stored on a flat surface standing on the legs 308, 312 (FIG. 3) and/or on the edge 700 (FIG. 7) of the tray 104. As described above, the drinking cups 102*a*-102*d* are coupled to the tray 104 by the rings 600 of the bottle tags 106*a*-106*d*. As such, when the tray 104 is tilted, hung vertically, and/or inverted (turned upside-down), the drinking cups 102*a*-102*d* do not fall out of the openings 108*a*-108*d* of the tray 104. Thus, the example tasting flight kit 100 can be conveniently and easily stored as a unit.

Example tasting flight kits have been disclosed herein. The following paragraphs provide various examples and example combinations of the examples disclosed herein.

Example 1 is a tasting flight kit including a drinking cup and a tray to support the drinking cup. The tray includes a base with a top side and a bottom side opposite the top side. An opening extends through the base between the top side and the bottom side. The opening has a larger diameter than a bottom portion of the drinking cup, such that when the drinking cup is inserted into the opening from the top side, the bottom portion of the drinking cup extends through the opening and beyond the bottom side. The tasting flight kit also includes a ring having an outer diameter larger than a diameter of the opening. The ring is to be placed around the bottom portion of the drinking cup when the drinking cup is inserted into the opening to prevent the drinking cup from being removed from the opening when the tray is inverted.

Example 2 includes the tasting flight kit of Example 1, wherein an upper portion of the drinking cup has a larger diameter than the opening, such that when the drinking cup is inserted into the opening from the top side, the upper portion engages the base.

Example 3 includes the tasting flight kit of any of Examples 1-2, wherein the bottom portion of the drinking cup has a groove to receive the ring.

Example 4 includes the tasting flight kit of any of Examples 1-3, wherein the ring is constructed of silicone.

Example 5 includes the tasting flight kit of any of Examples 1-4, wherein the drinking cup has indicia. The tasting flight kit further includes a tab coupled to the ring. The tab has indicia that matches the indicia on the drinking cup.

Example 6 includes the tasting flight kit of Example 5, wherein the indicia of the drinking cup is etched into an outer surface of the drinking cup.

Example 7 includes the tasting flight kit of Example 6, wherein the indicia on the tab is embossed on an outer surface of the tab.

Example 8 includes the tasting flight kit of any of Examples 5-7, wherein the tab is dimensioned such that when the ring is placed around the bottom portion of the drinking cup when the drinking cup is inserted into the opening, the tab does not extend beyond an edge of the base of the tray.

Example 9 includes the tasting flight kit of any of Examples 1-8, wherein the drinking cup has an enlarged portion forming a largest diameter of the drinking cup. The enlarged portion corresponds to one fluid ounce within the drinking cup.

Example 10 includes the tasting flight kit of any of Examples 1-9, wherein the tray includes a first leg and a second leg coupled to the base. The first and second legs are to support the base above a support surface when the tray is placed on the support surface.

Example 11 includes the tasting flight kit of Example 10, wherein the first leg has a first opening forming a first handle and the second leg has a second opening forming a second handle. The first and second handles are to be used to carry the tray.

Example 12 includes the tasting flight kit of any of Examples 1-11, wherein the tray is constructed of aluminum.

Example 13 includes the tasting flight kit of any of Examples 1-12, wherein the tray has a powder-coated finish.

Example 14 includes the tasting flight kit of any of Examples 1-13, wherein the drinking cup is constructed of glass.

Example 15 is a tasting flight kit including a first drinking cup. The first drinking cup has first indicia. The tasting flight kit includes a second drinking cup. The second drinking cup has second indicia that is different than the first indicia. The tasting flight kit also includes a tray to support the first drinking cup and the second drinking cup. The tasting flight kit includes a first bottle tag including a first ring and a first tab coupled to the first ring. The first tab has first indicia that matches the first indicia on the first drinking cup. The tasting flight kit further includes a second bottle tag including a second ring and a second tab coupled to the second ring. The second tab has second indicia that matches the second indicia on the second drinking cup.

Example 16 includes the tasting flight kit of Example 15, wherein the first and second bottle tags are constructed of silicone.

Example 17 includes the tasting flight kit of Examples 15-16, wherein the tray includes a base with a top side and a bottom side opposite the top side. First and second openings extend through the base between the top side and the bottom side. The first and second openings are to receive the first and second drinking cups, respectively.

Example 18 includes the tasting flight kit of Example 17, wherein the first opening has a larger diameter than a first bottom portion of the first drinking cup, such that when the first drinking cup is inserted into the first opening from the top side, the first bottom portion of the first drinking cup extends through the first opening and beyond the bottom side, and wherein the second opening has a larger diameter than a second bottom portion of the second drinking cup, such that when the second drinking cup is inserted into the second opening from the top side, the second bottom portion of the second drinking cup extends through the second opening and beyond the bottom side.

Example 19 includes the tasting flight kit of any of Examples 17-18, wherein the first ring has a first outer diameter larger than a diameter of the first opening, such that when the first ring is placed around the first bottom portion of the first drinking cup when the first drinking cup is inserted into the first opening, the first ring prevents the first drinking cup from being removed from the first opening when the tray is inverted.

Example 20 includes the tasting flight kit of any of Examples 17-19, wherein the second ring has a second outer diameter larger than a diameter of the second opening, such that when the second ring is placed around the second bottom portion of the second drinking cup when the second drinking cup is inserted into the second opening, the second ring prevents the second drinking cup from being removed from the second opening when the tray is inverted.

From the foregoing, it will be appreciated that example tasting flight kits have been disclosed that can facilitate pairing between drinking cup and beverage bottles via a set of bottle tags with corresponding indicators on both the drinking cups and bottle tags. The example tasting flight kits disclosed herein can enable safer transport of the tray with the drinking cups by using the bottle tags to secure the drinking cups to the tray to avoid or prevent spillage and/or a cup falling out of the tray. Additionally or alternatively, the example tasting flight kit presented herein can secure the drinking cups to the tray for storage of the kit on its legs, one of its side, and/or for hanging by a handle and can thus be a compact solution compared to previously known kits.

Although certain example methods, apparatus, and articles of manufacture have been disclosed herein, the scope of coverage of this patent is not limited thereto. On the contrary, this patent covers all methods, apparatus, and articles of manufacture fairly falling within the scope of the claims of this patent.

The following claims are hereby incorporated into this Detailed Description by this reference, with each claim standing on its own as a separate embodiment of the present disclosure.

What is claimed is:

1. A tasting flight kit comprising:

a drinking cup;

a tray to support the drinking cup, the tray including a base with a top side and a bottom side opposite the top side, an opening extending through the base between the top side and the bottom side, the opening having a larger diameter than a diameter of a bottom portion of the drinking cup, such that when the drinking cup is inserted into the opening from the top side, the bottom portion of the drinking cup extends through the opening and beyond the bottom side; and a ring having an outer diameter larger than the diameter of the opening, the ring to be placed around the bottom portion of the drinking cup when the drinking cup is inserted into the opening to prevent the drinking cup from being removed from the opening when the tray is inverted.

2. The tasting flight kit of claim 1, wherein an upper portion of the drinking cup has a larger diameter than the diameter of the opening, such that when the drinking cup is inserted into the opening from the top side, the upper portion engages the base.

3. The tasting flight kit of claim 1, wherein the bottom portion of the drinking cup has a groove to receive the ring.

4. The tasting flight kit of claim 1, wherein the ring is constructed of silicone.

5. The tasting flight kit of claim 1, wherein the drinking cup has indicia, the tasting flight kit further including a tab coupled to the ring, the tab having indicia that matches the indicia on the drinking cup.

6. The tasting flight kit of claim 5, wherein the indicia of the drinking cup is etched into an outer surface of the drinking cup.

7. The tasting flight kit of claim 6, wherein the indicia on the tab is embossed on an outer surface of the tab.

8. The tasting flight kit of claim 5, wherein the tab is dimensioned such that when the ring is placed around the bottom portion of the drinking cup when the drinking cup is inserted into the opening, the tab does not extend beyond an edge of the base of the tray.

9. The tasting flight kit of claim 1, wherein the drinking cup has an enlarged portion forming a largest diameter of the drinking cup, the enlarged portion corresponding to one fluid ounce within the drinking cup.

10. The tasting flight kit of claim 1, wherein the tray includes a first leg and a second leg coupled to the base, the first and second legs to support the base above a support surface when the tray is placed on the support surface.

11. The tasting flight kit of claim 10, wherein the first leg has a first opening forming a first handle and the second leg has a second opening forming a second handle, the first and second handles to be used to carry the tray.

12. The tasting flight kit of claim 1, wherein the tray is constructed of aluminum.

13. The tasting flight kit of claim 12, wherein the tray has a powder-coated finish.

14. The tasting flight kit of claim 1, wherein the drinking cup is constructed of glass.

15. A tasting flight kit comprising:

a first drinking cup, the first drinking cup having first indicia;

a second drinking cup, the second drinking cup having second indicia that is different than the first indicia;

a tray to support the first drinking cup and the second drinking cup;

a first bottle tag including a first ring and a first tab coupled to the first ring, the first tab having first indicia that matches the first indicia on the first drinking cup; and a second bottle tag including a second ring and a second tab coupled to the second ring, the second tab having second indicia that matches the second indicia on the second drinking cup.

16. The tasting flight kit of claim 15, wherein the first and second bottle tags are constructed of silicone.

17. The tasting flight kit of claim 15, wherein the tray includes a base with a top side and a bottom side opposite the top side, first and second openings extending through the base between the top side and the bottom side, the first and second openings to receive the first and second drinking cups, respectively.

18. The tasting flight kit of claim 17, wherein the first opening has a larger diameter than a diameter of a first bottom portion of the first drinking cup, such that when the first drinking cup is inserted into the first opening form the top side, the first bottom portion of the first drinking cup extends through the first opening and beyond the bottom side, and wherein the second opening has a larger diameter than a diameter of a second bottom portion of the second drinking cup, such that when the second drinking cup is inserted into the second opening from the top side, the second bottom portion of the second drinking cup extends through the second opening and beyond the bottom side.

19. The tasting flight kit of claim 18, wherein the first ring has a first outer diameter larger than the diameter of the first opening, such that when the first ring is placed around the first bottom portion of the first drinking cup when the first drinking cup is inserted into the first opening, the first ring prevents the first drinking cup from being removed from the first opening when the tray is inverted.

20. The tasting flight kit of claim 19, wherein the second ring has a second outer diameter larger than the diameter of the second opening, such that when the second ring is placed around the second bottom portion of the second drinking cup when the second drinking cup is inserted into the second opening, the second ring prevents the second drinking cup from being removed form the second opening when the tray is inverted.

* * * * *